US009293271B2

(12) United States Patent
Biedunkiewicz et al.

(10) Patent No.: US 9,293,271 B2
(45) Date of Patent: Mar. 22, 2016

(54) SWITCH APPARATUS OF AN ELECTRICAL CIRCUIT BREAKER COMPRISING A FORCE TRANSFER ELEMENT AND A HOLDING ELEMENT

(71) Applicant: Siemens Aktiengesellschaft, Munich (DE)

(72) Inventors: Pawel Biedunkiewicz, Berlin (DE); Jörg-Uwe Dahl, Werder (DE)

(73) Assignee: SIEMEND AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/580,313

(22) Filed: Dec. 23, 2014

(65) Prior Publication Data

US 2015/0262765 A1 Sep. 17, 2015

(30) Foreign Application Priority Data

Mar. 14, 2014 (DE) ..... 10 2014 204 749

(51) Int. Cl.
*H01H 1/20* (2006.01)
*H01H 3/30* (2006.01)
*H01H 73/04* (2006.01)

(52) U.S. Cl.
CPC ..... *H01H 1/205* (2013.01); *H01H 3/3052* (2013.01); *H01H 1/2025* (2013.01); *H01H 1/2058* (2013.01); *H01H 73/045* (2013.01)

(58) Field of Classification Search
CPC ..... H01H 1/20; H01H 1/2041; H01H 1/205; H01H 73/045; H01H 77/102; H01H 11/00; H01H 3/32; H01H 2235/004; H01H 3/3052; H01H 1/2025; H01H 1/2058
USPC ..... 200/336, 243–250, 400, 401, 275, 17 R, 200/290; 29/622
See application file for complete search history.

(56) References Cited

U.S. PATENT DOCUMENTS 6,281,461 B1 8/2001 Doughty
7,189,935 B1 * 3/2007 Hassan ..... H01H 1/205 200/244

(Continued)

FOREIGN PATENT DOCUMENTS

EP 2704172 A1 3/2014

OTHER PUBLICATIONS

Extended European Search Report dated Jul. 24, 2015.

*Primary Examiner* — Edwin A. Leon
(74) *Attorney, Agent, or Firm* — Harness, Dickey & Pierce, P.L.C.

(57) ABSTRACT

A switch apparatus includes at least two contact levers, arranged rotatably about a common rotation axis and arranged, at least sectionally, parallel to one another and spaced apart. The contact levers each have two contact lever arms including contact sections for respectively making contact with one fixed mating contact section of a power line element. The two first contact lever arms make contact with a first force transfer element, and the two second contact lever arms make contact with a second force transfer element for applying a spring force. At least one force transfer element has, in touching sections for touching the contact lever arms, a bulge which extends radially outwards, for the uniform transfer of the spring force to the contact lever arms. At least one holding element of the two holding elements may be configured to be movable relative to the power line elements via an articulated bearing.

16 Claims, 4 Drawing Sheets

(56) References Cited

U.S. PATENT DOCUMENTS 8,089,016 B2 * 1/2012 Dahl ..... H01H 1/2041 200/400

2006/0119455 A1 * 6/2006 Park ..... H01H 77/104 335/16

2014/0061015 A1 3/2014 Biedunkiewicz et al.

* cited by examiner

SWITCH APPARATUS OF AN ELECTRICAL CIRCUIT BREAKER COMPRISING A FORCE TRANSFER ELEMENT AND A HOLDING ELEMENT

PRIORITY STATEMENT

The present application hereby claims priority under 35 U.S.C. §119 to German patent application number DE 102014204749.8 filed Mar. 14, 2014, the entire contents of which are hereby incorporated herein by reference.

FIELD

At least one embodiment of the present invention generally relates to a switch apparatus of an electrical circuit breaker for interrupting a current flow of an electric current in an electrical circuit in the event of the occurrence of a tripping event and/or to an electrical circuit breaker having a switch apparatus.

BACKGROUND

It is known in principle that electrical circuit breakers, which can be configured, for example, in the form of a compact circuit breaker (MCCB=molded case circuit breaker) or an open circuit breaker (ACB=air circuit breaker), can also have, in addition to a thermal magnetic trip unit (TMTU), for example, a switch apparatus and advantageously a double-break switch apparatus for interrupting a current flow of an electric current in an electrical circuit in the event of the occurrence of a tripping event, such as, for example, a short-circuit current or an overload current.

In order to interrupt the current flow of the electric current, the switch apparatus, which has, for example, a double-break multifinger contact system, is therefore rotated or pivoted about a rotation axis by way of a rotor element in such a way that the contact between the current-conducting contact rails and the multifinger contact system is interrupted. On the basis of the interruption of the current flow of the electric current, consumers or loads connected to the electrical circuit are advantageously protected from damage in the event of the occurrence of the tripping event.

Furthermore, it is known in principle that double-break contact systems and in particular double-break multifinger contact systems in a circuit breaker make it possible to connect two arcs in series and therefore enable a greater switch-off capacity. In particular, a compact circuit breaker is used, for example, for implementing a dual function, namely protecting an installation from overload and short-circuit currents and protecting lines and electrical operating devices from damage as a result of ground faults, for example. The thermal magnetic trip unit of the circuit breaker has, in a known manner, firstly a thermal tripping apparatus for protecting the electrical circuit or an electrical apparatus or an electrical device from damage owing to an overload, and secondly a magnetic tripping apparatus for protecting the electrical circuit or an electrical apparatus or an electrical device from damage owing to a short circuit.

A short circuit and in particular an electrical short circuit is generally known as an accidental or unintentionally occurring conductive connection between two or more conductive parts, and primarily between two nodes of the electrical circuit, as a result of which the electrical potential differences between these conductive parts drop to a value equal to zero or virtually zero. In particular in relation to a circuit breaker, a short circuit is an abnormal connection between two isolated phases which are intended to be isolated or insulated from one another. A short circuit results in the presence of an excessive electric current, namely an overcurrent, which can result in damage to, overheating of, a fire in or even an explosion of the electrical circuit and/or the consumer. An overload is a less extreme state in comparison with the short circuit and is rather a longer-term overcurrent state.

When using a switch apparatus comprising a double-break (multifinger) contact system, there is the problem of uniform distribution of the contact pressure among the at least two fixedly installed contacts, with which contact is made by way of the double-break contact system or the at least two switching levers. In particular owing to manufacturing tolerances or else owing to wear over the life of the switch apparatus, the position of the movable contact of the double-break switching lever can change in relation to the fixedly installed contacts. However, it is necessary for the uniform force and position distribution of the interacting contact elements to still be provided even after a large number of switching cycles and also independently of corresponding manufacturing tolerances of the individual component parts, in order to avoid different resistances at the individual contact points of the contact system. In particular when using multifinger contact systems, and in particular double-break multifinger contact systems, it is necessary for there to be such a low resistance in the case of the at least two current phases arranged parallel to one another that, advantageously, a uniform current flow distribution among the individual current phases of the multifinger contact system can be made possible, as a result of which advantageously in turn less power losses result and heating of the entire switching apparatus can be avoided.

SUMMARY

Therefore, at least one embodiment of the present invention resides in at least partially eliminating the above-described disadvantages in the case of a switch apparatus, and in particular a double-break multifinger switch apparatus. Accordingly, at least one embodiment of the present invention is directed to a switch apparatus by which at least approximately identical contact forces can be generated in the course of double-break multifinger contact systems and, as a result, asymmetries which can arise owing to the tolerances of the component parts themselves and/or owing to the operational response of the switch apparatus, for example, can be compensated for in a simpler and less expensive manner and in a manner which ensures process reliability.

A switch apparatus of an electrical circuit breaker of an embodiment, for interrupting a current flow of an electric current in an electrical circuit in the event of the occurrence of a tripping event, includes at least one force transfer element, which has, in touching sections for touching the contact lever arms of a contact lever of the switch apparatus, a bulge which extends radially outwards for uniform transfer of a spring force onto the contact lever arms. Furthermore, an embodiment of the present invention is achieved by a switch apparatus of an electrical circuit breaker for interrupting a current flow of an electric current in an electrical circuit in the event of the occurrence of a tripping event, wherein the switch apparatus has at least one holding element for holding at least one spring element for applying a spring force, wherein the holding element is configured so as to be movable relative to the power line elements for conducting electric current by way of an articulated bearing.

In addition, an embodiment is directed to an electrical circuit breaker for interrupting a current flow of an electric current in an electrical circuit, which circuit breaker includes at least one switch apparatus.

Accordingly, the switch apparatus according to an embodiment of the invention advantageously has at least one force transfer element and particularly advantageously a first force transfer element and a second force transfer element, which are each used for applying a spring force to the individual contact lever arms. In this case, the first force transfer element is advantageously arranged in a region of the first contact lever arms of the contact levers arranged next to one another, wherein the first contact lever arms extend in a common direction, starting from the center point of the contact lever through which the rotation axis extends, with the result that the two first contact lever arms advantageously extend along two planes running parallel to one another, advantageously in an identical direction. Accordingly, the second force transfer element is arranged in the region of the second contact lever arms of the contact levers arranged next to one another, wherein the second contact lever arms extend along two mutually parallel planes, starting from the center point of the contact lever through which the rotation axis extends, with the result that the two second contact lever arms are oriented parallel to one another and extend in an identical direction.

BRIEF DESCRIPTION OF THE DRAWINGS

Embodiments of a switch apparatus according to the invention will be explained in more detail below with reference to drawings, in which, in each case schematically.

Elements with the same function and mode of operation are provided in each case with the same reference symbols in FIGS. 1 to 8.

DETAILED DESCRIPTION OF THE EXAMPLE EMBODIMENTS

Figure 1:
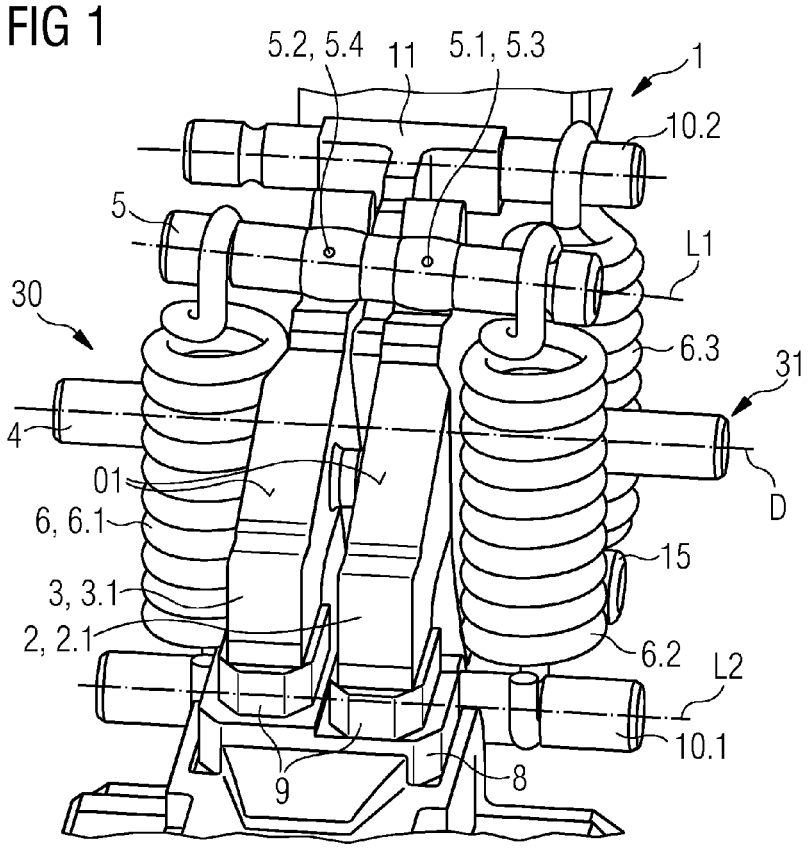
FIG. 1 shows a perspective view of an embodiment of a switch apparatus according to the invention.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes,"

and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The switch apparatus according to an embodiment of the invention of an electrical circuit breaker for interrupting a current flow of an electric current in an electrical circuit in the event of the occurrence of a tripping event includes at least two contact levers, which are arranged rotatably about a common rotation axis and are arranged, at least sectionally, parallel to one another and spaced apart from one another, which contact levers each have two contact lever arms comprising contact sections for making contact with in each case one fixed mating contact section of a power line element, wherein the two first contact lever arms, which extend on a first side of the rotation axis, make contact with a first force transfer element, and the two contact lever arms, which extend on a second side of the rotation axis, make contact with a second force transfer element for applying a spring force to the contact lever arms, and wherein at least one force transfer element of the two force transfer elements has, in touching sections for touching the contact lever arms, a bulge which extends radially outwards for the uniform transfer of the spring force onto the contact lever arms.

Accordingly, it is conceivable for the force transfer element to be able to have two or else more touching sections, in particular when the switch apparatus is one which has two or more contact levers. Advantageously, the switch apparatus therefore serves the purpose of isolating an electrical consumer or an electrical device or a load which is connected to the electrical circuit from the electrical circuit and therefore of interrupting the electrical circuit in the event of a tripping event, which may be, for example, a short-circuit current or an overload current, in such a way that said electrical consumer is not damaged.

For this purpose, the switch apparatus has at least two contact levers, which each have two contact lever arms. The contact lever or switching lever which is used for opening or for closing the electrical circuit is arranged rotatably or pivotably about a rotation axis. The two contact lever arms of the individual contact lever each extend outwards and advantageously diametrically outwards, starting from the center of the contact lever and in particular the region arranged or rotatably arranged on the rotation axis.

Accordingly, the first contact lever arm of the contact lever has a contact section, which is oriented in a first direction, for making contact with a fixed mating contact section, while the second contact lever arm of the contact lever has a contact section which is oriented in a second direction, which is opposite the first direction, in order to make contact with another mating contact section of a further power line element or a further section of the power line element. Therefore, the two contact sections of the contact lever lie on mutually opposite sides of the contact lever. As a result, simultaneous detachment of the two contact sections from the respective mating contact sections is made possible advantageously in the case of pivoting or rotation of the contact lever about a rotation axis. On the basis of this mutual detachment, in an embodiment of the present invention reference is made to a double-break switch system or a double-break switch apparatus.

The power line elements themselves are advantageously current-conducting lines for conducting the electric current of the electrical circuit, wherein the circuit breaker advantageously has a power supply line or a power supply line element and an outgoing power line element, between which the switch apparatus is arranged. The switch apparatus during normal operation serves the purpose of conducting the electric current coming from the power supply line element in the direction of the outgoing power line element and, in the case of the occurrence of the tripping event, interrupting this current conduction.

In accordance with an embodiment of the present invention, the switch apparatus therefore has a multifinger contact system and in particular a double-break multifinger contact system, wherein a multifinger contact system is characterized by the use of at least two contact levers, wherein each contact lever has two contact lever arms and therefore two contact sections for making contact with a mating contact section of a power supply element and an outgoing power line element, as a result of which, in turn, a double-break switch apparatus can be realized. Advantageously, the switch apparatus according to an embodiment of the invention therefore has two contact levers, which are arranged next to one another and advantageously, at least sectionally, spaced apart from one another, with the result that two or more contact points, consisting of a contact section and a mating contact section, can be realized per switching side.

In order to enable compensation for the contact forces per contact point, and therefore to realize uniform current distribution among the two contact levers arranged next to one another, it is necessary to press the contact sections of the contact lever arms of the contact levers onto the mating contact sections of the respective power line elements with a correspondingly comparable force in order to enable the occurrence of a low resistance between the contact sections and the mating contact sections. Advantageously, this is intended to be made possible without the individual contact lever arms of the contact levers, which contact lever arms are arranged parallel to one another, needing to each have individual spring-loading.

Accordingly, the switch apparatus according to an embodiment of the invention advantageously has at least one force transfer element and particularly advantageously a first force transfer element and a second force transfer element, which are each used for applying a spring force to the individual contact lever arms. In this case, the first force transfer element is advantageously arranged in a region of the first contact lever arms of the contact levers arranged next to one another, wherein the first contact lever arms extend in a common direction, starting from the center point of the contact lever through which the rotation axis extends, with the result that the two first contact lever arms advantageously extend along two planes running parallel to one another, advantageously in an identical direction. Accordingly, the second force transfer element is arranged in the region of the second contact lever arms of the contact levers arranged next to one another, wherein the second contact lever arms extend along two mutually parallel planes, starting from the center point of the contact lever through which the rotation axis extends, with the result that the two second contact lever arms are oriented parallel to one another and extend in an identical direction.

Advantageously, each force transfer element is arranged on that side of the contact lever arms which is opposite the side on which the contact section is arranged. Accordingly, for example, when a spring force and in particular a compressive force is applied to the force transfer element, this force can be applied to the contact lever arms of the respective contact levers via the force transfer element in such a way that, as a result, the contact section of the contact lever arms can be pressed onto the respective principally fixed mating contact section of the power line element. In order to enable uniform transfer of force, and in particular of spring force, onto the individual contact lever arms and therefore onto the individual contact sections of the contact lever arms, independently of wear phenomena on the contact sections or mating contact sections and/or independently of individual manufacturing tolerances of the corresponding component parts, the force transfer element has, in accordance with the invention, at least one bulge, which extends radially outwards and is arranged in one of the advantageously two touching sections of the force transfer element.

Each touching section preferably makes direct contact with a contact lever arm of a contact lever and in particular with one side of the contact lever arm of a contact lever. The bulge or bulges of the force transfer element can in this case advantageously extend in a circumferential direction and have, for example, a spherical or triangular or egg-shaped or oval configuration. Advantageously, the force transfer element has two bulges of the abovementioned type, which are arranged spaced apart from one another and advantageously have the same configuration. It is thus possible for the bulges of the force transfer element to be configured in such a way that, when contact is made with the bulges, and in particular the touching sections of the force transfer element by the respective contact lever arm, a force and in particular a spring force can be applied to the individual contact lever arms of the individual contact levers in such a way that each contact lever arm, and in particular the two first contact lever arms of the contact levers or the two second contact lever arms of the contact levers, have a physical lever arm which is identical to one another. Within the scope of the invention, a physical lever arm or a lever arm or a lever is understood to mean a spacing between the center point through which the rotation axis of the lever arm passes and the point of action of the force or the spring force which presses onto the sides of the lever arms.

It is furthermore conceivable for the force transfer element to be arranged tiltably via its bulge relative to the power line elements. This means that the force transfer element or else the force transfer elements which has/have a longitudinal axis which extends advantageously substantially parallel to the rotation axis of the contact lever, wherein the force transfer element is advantageously configured in the form of a cylinder or a pin, can be tilted along the contact lever arms in such a way that the longitudinal axis of the force transfer element is oriented at a defined angle to the rotation axis of the contact lever. As a result, the force transfer element or the at least two force transfer elements of the switching apparatus is/are arranged movably with respect to the power line elements. Advantageously, at least one of the force transfer elements does not have a bearing region, but extends freely movably over the corresponding contact lever arms of the contact levers, with the result that the longitudinal axis of the force transfer elements is therefore oriented substantially orthogonal to a longitudinal axis of the contact lever arms.

It is furthermore conceivable for at least one bulge of the advantageously two bulges to have a spherical configuration, an elliptical configuration, a pyramidal configuration, a conical configuration, a cubical configuration, a prismatic configuration or a cylindrical configuration. Within the scope of the invention, it is conceivable for the bulge itself to consist of an amalgamation of a plurality of bulges and advantageously two bulges of the abovementioned type, wherein the bulges or sections of the bulge are next to one another in a row along the longitudinal axis of the force transfer element. It is furthermore possible for the bulge to not be restricted to a defined configuration, with the result that the bulge can have any configuration.

Advantageously, the bulge is configured in such a way that a defined force point can be generated between the bulge and, as a result, the respective touching section of the force transfer element and the corresponding contact lever arms of the contact levers. Advantageously, the bulge extends at least sectionally in the circumferential direction around the force transfer element and particularly advantageously in the complete circumferential direction around the force transfer element, at least in the region of the corresponding touching section, with the result that, taking into consideration a poka-yoke principle, faulty or incorrect application of the force transfer element in the region of the contact lever arms can be avoided.

Within the scope of embodiments of the invention, it is furthermore possible for the spring force to be applied to the force transfer elements in each case by at least two spring elements, wherein the spring elements each extend between the respective force transfer element and a holding element for holding the spring elements. The holding element advantageously serves the purpose of holding at least one spring element and advantageously two spring elements, which can be a tension spring, for example, and in particular of positioning said spring element(s) with respect to the contact lever arms or the contact levers.

Advantageously, the holding element itself has a cylindrical and in particular a pin-shaped configuration, whose longitudinal axis extends substantially parallel to the rotation axis of the contact levers. Advantageously, the holding element is connected in rotationally fixed fashion to a holding arm, which is fixed on a housing of the switch apparatus, for example. However, it is also conceivable for the holding element itself to be a component part of the housing of the switch apparatus into which, for example, the spring element is hooked in or locked, at least with a first side.

Advantageously, the holding element is arranged immovably or in rotationally rigid fashion (rotationally fixed fashion). Within the scope of embodiments of the invention, it is advantageously possible to assign a holding element to each force transfer element, wherein the force transfer element is arranged on a first side of the lever arm, while the holding element is arranged on a second side opposite the first side. Advantageously, the holding element is arranged on that side of the contact lever arm on which the contact section for making contact with the mating contact section of the power line element is also arranged. It is therefore conceivable for the holding element to be understood as a mating element for the force transfer element, wherein at least one spring element and advantageously two spring elements are arranged between the force transfer element and the holding element, which is assigned correspondingly to the force transfer element, which spring element(s) extend(s) from the force transfer element to the holding element, therefore.

Furthermore, it is conceivable for the holding elements or at least one of the holding elements to be arranged movably relative to the power line elements by way of an articulated bearing. The articulated bearing itself is in this case advantageously a revolute joint or a swivel joint and enables a rotary movement or pivoting movement of the holding element about a pivot axis. Accordingly, it is possible for advantageously the force transfer element and also the holding element itself to be arranged movably with respect to the power line elements and to be able to pivot or move, at least sectionally, about corresponding pivot axes in order to enable simple compensation for asymmetries in the switch apparatus and uniform application of a contact-pressure force between the individual contact sections and mating contact sections. The revolute joint or swivel joint can be a ball joint, for example.

It is furthermore conceivable for the touching sections of the force transfer elements to each have at least one touching point for touching the contact lever arms, wherein the touching points generate an identical (physical) lever arm independently of the positioning of the force transfer elements and/or of the contact lever arms relative to the power line elements on each contact lever arm. In this case, it is conceivable for the touching points to be able to form a touching area and/or a touching line. Owing to the generation of an identical lever arm in the contact lever arms of each contact lever which are oriented parallel to one another and in particular between the first contact lever arms or between the second contact lever arms of the contact levers, an identical contact-pressure force of the contact sections on the mating contact sections of the power line elements is advantageously made possible, with the result that, advantageously, an identical and therefore low resistance between the contact sections and the mating contact sections is produced and uniform distribution of the current flow of the electric current among the at least two lever arms can take place.

Furthermore, a switch apparatus of an electrical circuit breaker for interrupting a current flow of an electric current in an electrical circuit in the event of the occurrence of a tripping event is claimed, wherein the switch apparatus has at least two contact levers, which are arranged rotatably about a common rotation axis and are arranged, at least sectionally, parallel to one another and spaced apart from one another, which contact levers each have two contact lever arms comprising contact sections for making contact with in each case one fixed mating contact section of a power line element, wherein a first holding element for holding at least one spring element for applying a spring force to the first contact lever arms extending on a first side of the rotation axis and a second holding element for holding at least one spring element for applying a spring force to the second contact lever arms extending on a second side of the rotation axis are arranged, and wherein at least one holding element of the two holding elements is configured so as to be movable relative to the power line elements by way of an articulated bearing. The switch apparatus according to an embodiment of the invention has all of the advantages which have been described in relation to a switch apparatus according to an embodiment of the invention in accordance with the first aspect of the invention.

Accordingly, the switch apparatus according to an embodiment of the invention therefore serves to interrupt the current flow of the electric current in the electrical circuit in the event of the occurrence of a tripping event, such as a short-circuit current or an overload current, in order to protect the electrical consumer connected to the electrical circuit or the load from damage. As described with respect to the switch apparatus in accordance with the first aspect of an embodiment of the invention, the switch apparatus of the type mentioned here likewise has two contact levers, which are arranged rotatably about a common rotation axis, and therefore advantageously implements a double-break multifinger contact system. Each contact lever has two contact lever arms, which extend outwards starting from a center point of the contact lever through which the rotation axis extends and are advantageously arranged diametrically to one another. In respect of the configuration of the contact levers and the respective contact lever arms, reference is made to the description above, which is used completely to explain the switch apparatus mentioned here.

The switch apparatus according to an embodiment of the invention now has a first holding element and advantageously a second holding element for holding and advantageously for positioning a spring element, which can be a tension spring, for example. In this case, the holding element or the at least two holding elements, which can each be a component part of the switch apparatus itself, and advantageously have a cylindrical or pin-shaped configuration, extend with their longitudinal axis substantially parallel to the rotation axis of the contact levers. Advantageously, the first holding element is arranged in particular in a first region of the contact levers, along which the first contact lever arms of the two contact levers extend. Accordingly, the second element is arranged in a second region of the contact levers, along which the respective second contact lever arms of the respective contact levers extend.

The spring elements themselves advantageously serve the purpose of applying a spring force and in particular a compressive force to the contact lever arms in order to press the contact lever arms in the direction of the respective power line elements and advantageously to move the contact lever arms in such a way that the contact sections can be applied with comparable force onto the mating contact sections, which are arranged on the power line elements.

In order to enable compensation for and uniform application of the spring force onto the individual contact sections, independently of corresponding manufacturing tolerances of the individual component parts or wear phenomena of the contact sections, it is possible according to the invention for at least one holding element of the at least two holding elements to be configured so as to be movable relative to the power line elements by way of an articulated bearing.

It is therefore thus conceivable for at least one holding element to be configured in the form of a cylinder or pin and to have an articulated bearing in order to move, for example, with respect to a holding arm for holding the holding element. Meanwhile, it is conceivable for the second holding element to be capable of being a component part of the housing of the switch apparatus, for example, which serves the purpose of holding the spring element and is arranged in rotationally rigid and immovable fashion.

However, it is also conceivable for both holding elements to be configured in the form of a cylinder and in particular a pin and advantageously to have a longitudinal axis which extends substantially parallel to a rotation axis of the contact levers, wherein it is also conceivable for both holding elements to have an articulated bearing in order to enable a movement of the holding elements relative to the power line elements.

Within the scope of embodiments of the invention, it is conceivable for the articulated bearing to have a revolute joint or a swivel joint, which enables a rotary movement or pivoting movement of the holding element at least about a pivot axis which extends substantially orthogonal or at a defined angle to the rotation axis. Advantageously, the revolute joint or the swivel joint is a ball joint. The pivot axis about which the holding element can pivot or rotate at least sectionally can advantageously extend in a plane which extends parallel to the plane in which the rotation axis extends.

However, it is also possible for the rotation axis and pivot axis to lie in planes which are oriented at a defined angle, and in particular at an acute angle, to one another. It is furthermore conceivable for the holding arm for holding the holding element, which is advantageously connected in rotationally rigid fashion to a housing of the switch apparatus, for example, to have a cutout and in particular a bore, through which at least one section of the holding element extends, wherein the cutout is configured in such a way that at least regional pivoting or rotation of the holding element about the mentioned pivot axis can be made possible. Advantageously, the holding element itself has an articulated section, which is in contact with the holding arm for holding the holding element, wherein this articulated section can advantageously have a spherical configuration.

It is furthermore conceivable for a spring force to be applied to the holding elements in each case by at least two spring elements, wherein the spring elements each extend between the respective holding element and a force transfer element for transferring a spring force onto the contact lever arms. In this case, it is conceivable for at least one force transfer element to be assigned to each holding element in an advantageous manner, wherein the force transfer element can also be configured so as to be movable.

It is thus conceivable for the force transfer element to be configured in the form of a cylinder and in particular a pin, which can have at least one bulge, for example in particular in touching sections for touching the contact lever arms of the contact levers. The spring elements, which can advantageously be tension springs, extend between a holding element and the advantageously associated force transfer element.

Advantageously, the switch apparatus according to an embodiment of the invention has in total two holding elements and two force transfer elements, wherein each holding element/force transfer element pair advantageously has in each case two spring elements, which extend in each case between the force transfer element and the holding element, as a result of which a force transfer pair is formed. The spring element system of the switch apparatus, which spring element system advantageously consists of four spring elements and two holding elements and two force transfer elements, advantageously serves the purpose of applying an identical spring force to the individual contact lever arms of the individual contact levers, wherein, advantageously, component tolerances and/or different degrees of wear of the individual contact sections of the contact lever arms can be compensated for.

Advantageously, it is conceivable for the switch apparatus to have at least one force transfer element, and at least one holding element. Accordingly, it is possible for the switch apparatus to advantageously have a force transfer element, which has a bulge, which extends radially outwards, for uniformly transferring the spring force onto the contact lever arms in touching sections for touching the contact levers once, and a holding element, which is configured so as to be movable relative to the power line elements by way of an articulated bearing. Owing to a configuration of the switch apparatus with a movable force transfer element and a movable holding element, compensation for component part tolerances and for different regions of wear of the individual contact levers and the contact lever arms thereof and the contact sections of the contact lever arms can be provided in a simple and inexpensive manner, with the result that, advantageously, an identical contact pressure can be made possible between the individual contact sections and the mating contact sections.

It is furthermore conceivable for the force transfer element and/or the holding element to extend along a longitudinal axis, which extends substantially parallel or at an acute angle or at an obtuse angle to a rotation axis of the contact lever arms, wherein the force transfer element extends along a first surface of the contact lever arms and the holding element extends along a second surface, which is opposite the first surface, of the contact lever arms. Accordingly, a force transfer element is advantageously opposite a holding element.

Advantageously, therefore, the longitudinal axes of the force transfer element and the holding element extend substantially parallel to one another. The force transfer element and the holding element form a force transfer pair and are operatively connected to one another via at least one spring element and advantageously two spring elements. This means that the at least one spring element is clamped between a force transfer element and a holding element in such a way that a defined spring force can be transferred from the spring element onto the force transfer element.

An electrical circuit breaker for interrupting a current flow of an electric current in an electrical circuit is furthermore claimed, the electrical circuit breaker having at least one switch apparatus. Accordingly, the electrical circuit breaker, which can be a compact circuit breaker or else an open circuit breaker, for example, has at least one switch apparatus in accordance with the abovementioned type. In the case of the electrical circuit breaker, all of the advantages which have already been described with respect to the switch apparatuses in accordance with the preceding aspects of embodiments of the invention result.

FIG. 1 shows a perspective view of an embodiment of a switch apparatus 1 according to the invention. The switch apparatus 1 of an electrical circuit breaker has two contact levers 2, 3, which are arranged next to one another, parallel to one another and spaced apart from one another and rotate or pivot about a common rotation axis D, which extends along a rotor 4 or an axis of a rotor 4. The rotor 4 advantageously serves the purpose of rotating or pivoting the contact levers 2 and 3 about the rotation axis D in the event of the occurrence of a tripping event, such as, for example, an overload or a short circuit in the electrical circuit, as a result of which the contact sections 9 arranged on the contact lever arms 2.1, 2.2, 3.1, 3.2, of which in each case the first contact lever arms 2.1 and 3.1 of the contact levers 2, 3 are shown in FIG. 1, are spaced apart from the mating contact sections 8, which are arranged on power line elements 7.

The first contact lever arms 2.1 and 3.1 shown in FIG. 1 and also the second contact lever arms 2.2 and 3.2 (not illustrated here) each have a first surface O1, which is opposite a second surface O2, on which the contact sections 9 are arranged. A first force transfer element 5 is arranged in the region of the first surface O1 of the first contact lever arms 2.1, 3.1, wherein touching sections 5.1 and 5.2 of the first force transfer element 5 touch the contact levers 2, 3 and in particular the first contact lever arms 2.1, 3.1 of the contact levers 2, 3. The touching sections 5.1, 5.2 of the force transfer element 5 are configured in the form of bulges 5.3 and 5.4, respectively, or have such bulges 5.3, 5.4, wherein the bulges 5.3, 5.4, which can also be referred to as protuberances, advantageously have a spherical configuration, which extends preferably uniformly radially outwards in a circumferential direction around the force transfer element 5. The bulges 5.3 and 5.4 are therefore projections, which extend radially outwards and in particular make contact with first surfaces O1 of the contact lever arms 2.1 and 3.1.

The embodiment of the switch apparatus 1 according to the invention shown in FIG. 1 also has at least one spring element 6 and advantageously four spring elements 6.1, 6.2, 6.3, 6.4, wherein only three spring elements 6.1, 6.2, 6.3 of the four possible spring elements 6.1, 6.2, 6.3, 6.4 are shown in FIG. 1. The spring elements 6, 6.1-6.3 each extend between a force transfer element 5 or 15, wherein a second force transfer element is denoted by the reference symbol 15, and a corresponding holding element 10.1 or 10.2. Advantageously, a holding element 10.1 or 10.2 is assigned to each force transfer element 5 or 15. Accordingly, for example, the first spring elements 6.1 and 6.2 extend between the first force transfer element 5 and the first holding element 10.1, while the remaining spring elements 6.3 extend between the second force transfer element 15 and the second holding element 10.2.

Figure 7:
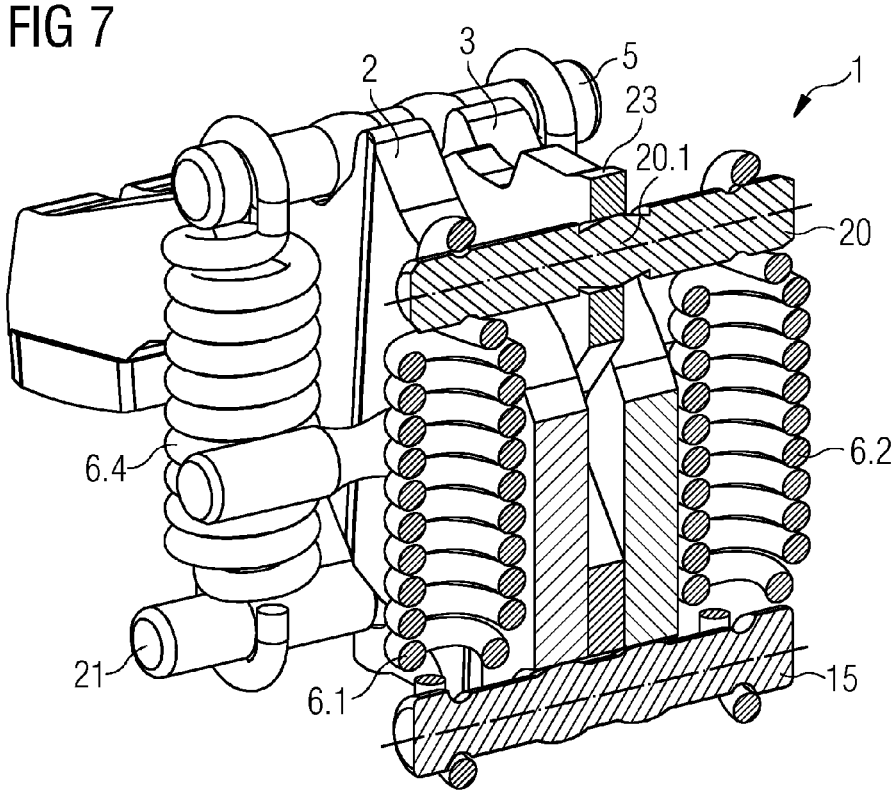
FIG. 7 shows a perspective view of a partial section through a force transfer pair of the embodiment shown in FIGS. 5 and 6 of a switch apparatus according to the invention.

A force transfer element 5 or 15 and an associated holding element 10.1 or 10.2, with corresponding spring elements 6.1, 6.2 or 6.3, form a force transfer pair 30 or 31 (cf. also FIG. 7).

The holding elements 10.1 or 10.2 of each force transfer pair 30, 31 is always arranged in the region of a side or surface or on a side or surface of the contact lever 2 or 3 and in particular of the contact lever arm 2.1 or 3.1 which is opposite the side or surface on which the force transfer element 5 or 15 is arranged. As a result, the contact levers 2, 3 and in particular the contact lever arms 2.1, 3.1 thereof extend in a region between the force transfer element 5 or 15 and the associated holding element 10.1 or 10.2. This is illustrated again in particular with the embodiment of the switch apparatus 1 according to the invention depicted in FIG. 2. The holding elements 10.1 and 10.2 advantageously extend along a longitudinal axis L2 and have, for example, a cylindrical and advantageously pin-shaped configuration. For a preferably motionless arrangement of the holding element 10.1 or 10.2, said holding element is connected to a holding arm 11 or fixed thereto. The holding arm 11 can in this case itself be connected to an immovable component part of the switch apparatus 1, such as a housing, for example. The force transfer element 5 or 15 advantageously extends along a longitudinal axis L1 and has a cylindrical or preferably pin-shaped configuration. The longitudinal axes L1 and L2 advantageously extend substantially parallel to the rotation axis D or run in planes which extend parallel to a plane in which the rotation axis D runs. However, in particular owing to asymmetries of the component parts, it is possible for the longitudinal axis L1 and/or the longitudinal axis L2 to be arranged at a defined angle, such as, for example, an acute angle or an obtuse angle, to the rotation axis D or to extend at a corresponding angle to the rotation axis D. Advantageously, the longitudinal axes L1 and L2 and the rotation axis D extend in the same direction.

Figure 2:
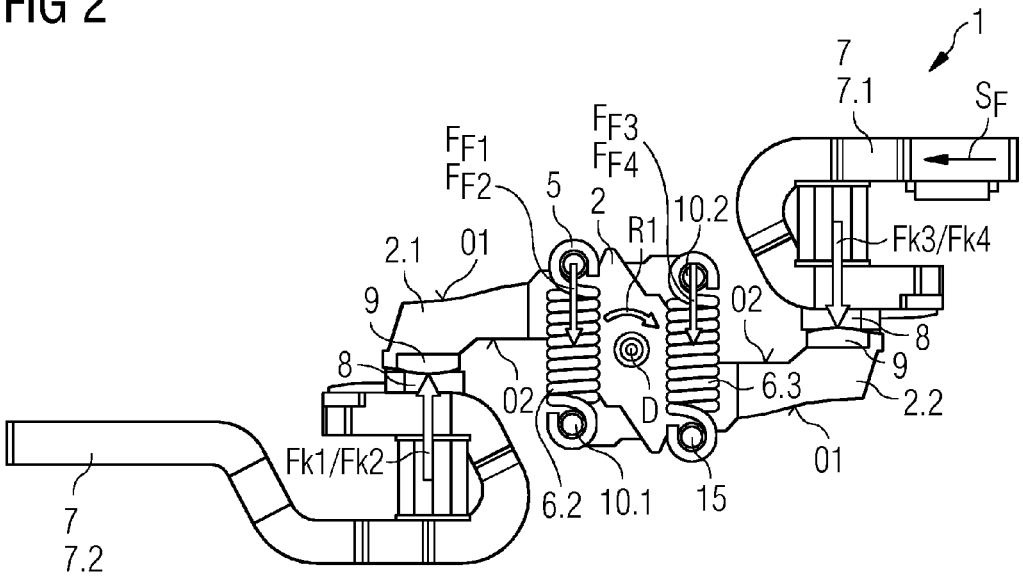
FIG. 2 shows a side view of a further embodiment of a switch apparatus according to the invention.

FIG. 2 shows a side view of a further embodiment of a switch apparatus 1 according to the invention, which, as already described in relation to the embodiment of the switch apparatus 1 according to the invention illustrated in FIG. 1, has at least two contact levers 2 and 3, wherein in this case only one contact lever 2 is shown. The contact levers 2, 3 have a first contact lever arm 2.1 or 3.1 and a second contact lever arm 2.2 or 3.2, which extend outwards in mutually opposite directions, starting from a rotation axis D. The contact lever arms 2.1 and 2.2 or 3.1 and 3.2 are advantageously arranged diametrically and each have a first surface O1 or a first side O1 and a second surface O2 or a second side O2.

A first force transfer element 5 is arranged on the first surface O1 of the first contact lever arm 2.1 of the contact lever 2, while a first holding element 10.1 is arranged at least in a region on the second side O2 or surface O2 of the first contact lever arm 2.1 of the contact lever 2. The longitudinal axis L1 of the force transfer element 5 (cf. FIG. 1 as well) and the longitudinal axis L2 of the holding element 10.1, which is preferably a rigid axis (cf. also FIG. 1), extend in planes oriented parallel to one another and therefore parallel to one another in substantially the same direction.

During a rotation or pivoting of the contact lever 2 about the rotation axis D in a first direction of rotation R1, the spring elements 6 and in particular the spring elements 6.1, 6.2 shown in FIG. 2 and also the spring elements 6.3 and 6.4 (not shown here) have a force applied to them in such a way that the lengths of the spring elements 6, 6.1-6.4 are extended. At the same time, the contact sections 9 lift off from the mating contact sections 8 of the power line elements 7, with the result that a current flow SF of an electric current, coming from a region of the power line element 7, which can also be referred to as power feedline element 7.1, and flowing in the direction of a region of a power line element 7, which can also be referred to as outgoing power line element 7.2, is interrupted.

If there is no rotary movement of the contact lever 2 about its rotation axis D, triggered owing to the rotation of the rotor 4, which extends along the rotation axis D through a central region of the contact lever 2, the spring elements 6, 6.1-6.4 apply a corresponding spring force FF1 and FF3 or FF2 and FF4 to the corresponding contact lever arms 2.1 and 2.2 of the contact lever 2 (shown here) or 3.1 and 3.2 of the contact lever 3 (not shown here), which spring force is passed on to the contact lever 2 or 3 and the contact lever arms 2.1 and 2.2 or 3.1 and 3.2 thereof via the force transfer elements 5 and 15. As a result, the contact sections 9 are pressed onto the mating contact sections 8, with the result that as little resistance as possible is produced between the contact sections 9 and the mating contact sections 8. Advantageously, the spring forces $F_{F1}$, $F_{F3}$, $F_{F2}$ and $F_{F4}$ effect contact-pressure forces $F_{K1}$, $F_{K3}$, $F_{K2}$ and $F_{K4}$ which are identical in magnitude to one another between the contact sections 9 and the corresponding mating contact sections 8.

Figure 3:
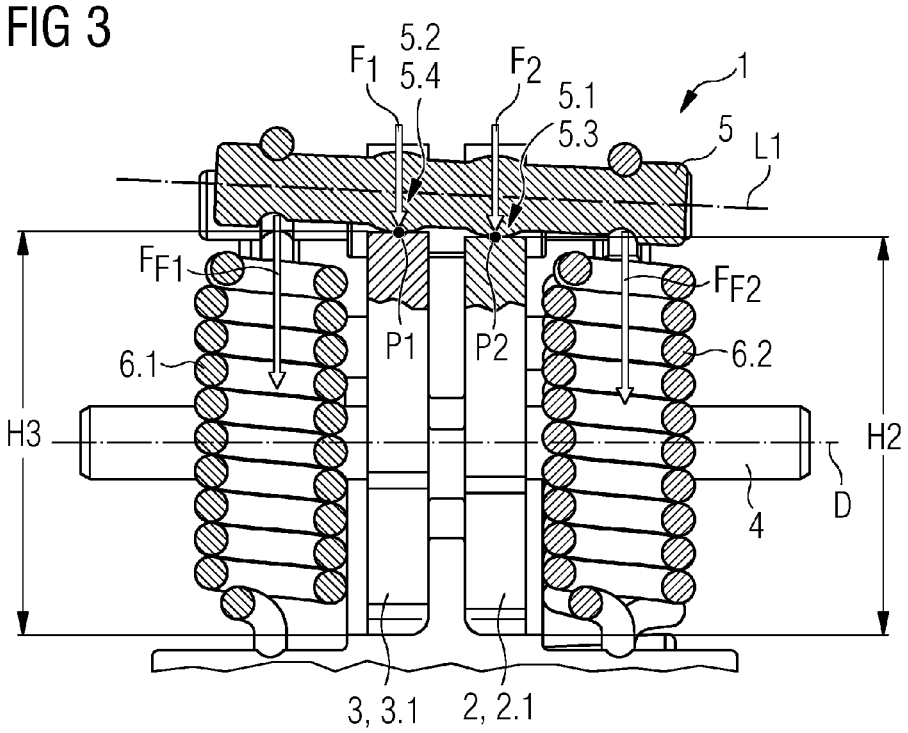
FIG. 3 shows a sectional view, from the front, of an embodiment of a switch apparatus according to the invention as illustrated in FIG. 1 or FIG. 2.

FIG. 3 shows a sectional view, from the front, of an embodiment of a switch apparatus 1 according to the invention as illustrated in FIG. 1 or FIG. 2. As can be seen from FIG. 3, the two contact levers 2, 3 have different heights H2 and H3 from one another, wherein in particular the height H3 of the second contact lever 3 is greater than the height H2 of the first contact lever 2. The heights H2 and H3 denote the spacing between the region in which the contact sections 9 make contact with the mating contact sections 8 and the region in which the touching sections 5.1 and 5.2 of the force transfer element 5 make contact with the first surfaces O1 of the contact lever arms 2.1 and 3.1. The different heights H2 and H3 are produced, for example, owing to individual different manufacturing tolerances and/or owing to wear and erosion phenomena, specifically on the contact sections 9 of the individual contact lever arms 2.1, 2.2 or 3.1, 3.2.

The bulges 5.3 and 5.4 of the individual touching sections 5.1 and 5.2 of the force transfer element 5 advantageously have touching points P1 and P2, which can also be configured in the form of touching areas and/or touching lines and directly touch the first surface O1 of the first contact lever arms 2.1, 3.1 and conduct a force flow to the individual contact lever arms 2.1, 3.1 of the contact levers 2, 3, starting from the force transfer element 5. On the basis of these bulges 5.3 and 5.4, the force F1 and F2 acting on the contact lever arms 2.1, 3.1, which force is advantageously a compressive force, is advantageously applied to the contact lever arms 2.1, 3.1 or 2.2, 3.2 in such a way that, for example, a physical lever arm which is always of the same size is produced in the contact levers 2, 3, for example independently of a different spring force $F_{F1}$ or $F_{F2}$ or $F_{F3}$ or $F_{F4}$ of the individual spring elements 6.1 and 6.2 or 6.3 and 6.4, with the result that the contact levers 2, 3 and in particular the contact sections 9 of the contact lever arms 2.1, 3.1 or 2.2, 3.2 are pressed onto the mating contact sections 8 with an identical force and in particular contact-pressure force $F_{K1}$, $F_{K2}$ or $F_{K3}$, $F_{K4}$ (cf. FIG. 2). This is also possible when, as shown in FIG. 3, the first longitudinal axis L1 of the first force transfer element 5 extends at a defined angle to the rotation axis D, with the result that the rotation axis D and the longitudinal axis L1 no longer extend parallel to one another in the same direction and no longer extend in planes which are oriented parallel to one another.

Figure 4:
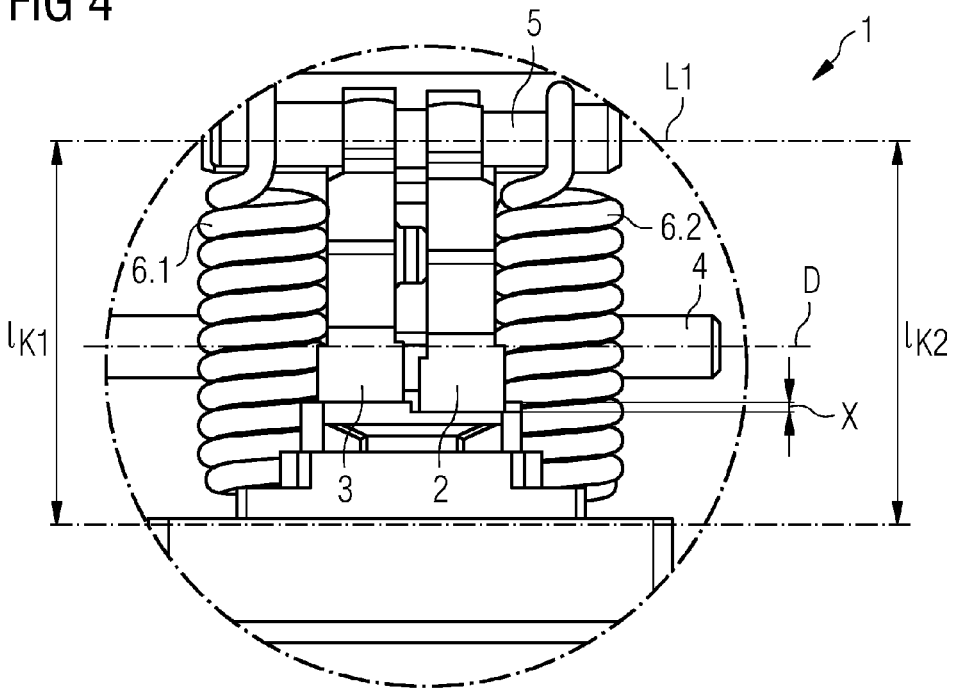
FIG. 4 shows a sectional view, from the front, of a detail of a further embodiment of the switch apparatus according to the invention.

The same also applies in the case of an asymmetrical design of the switch apparatus 1, as shown in FIG. 4, for example, in which a sectional view, from the front, of a detail of a further embodiment of the switch apparatus 1 according to the invention is shown. The asymmetry X in this case arises, for example, owing to a construction-related or else manufacturing-related different height of the mating contact regions 8, as a result of which, in turn, the heights H2 and H3 shown in FIG. 3 and therefore also the lengths lk1 and lk2 of the spring elements 6.1 and 6.2 can be different. By way of the force transfer element 5 or 15 which is arranged pivotably or movably (as shown in FIG. 1), compensation for this asymmetry X and advantageously application of an identical compressive force on the mating contact sections 8 is therefore possible.

Figure 5:
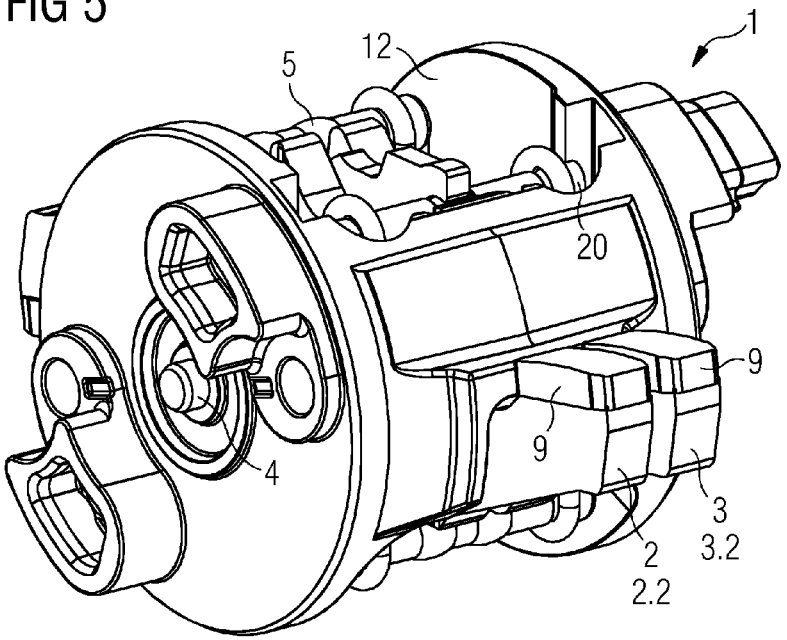
FIG. 5 shows a perspective view of a further embodiment of a switch apparatus according to the invention, arranged within a housing.

FIG. 5 shows a perspective view of a further embodiment of a switch apparatus 1 according to the invention within a housing 12. The switch apparatus 1 shown here has, in addition to the switch apparatuses 1 shown in FIGS. 1 to 4, a holding element 20 or 21 which is configured so as to be movable about a pivot axis S1, S2, S3. It is thus conceivable for the switch apparatus 1 to advantageously have two elements, which are movable relative to the power line elements 7 or 7.1 and 7.2, as shown in FIG. 2, for example, namely a movably arranged force transfer element 5 and in particular two movably arranged force transfer elements 5 and 15 and at least one movably arranged holding element 20 and advantageously two movably arranged holding elements 20 and 21. The switch apparatus 1 is advantageously surrounded at least sectionally by a housing 12, which can also be a component part of the switch apparatus 1 according to the invention and also of the switch apparatus 1 according to the invention shown in FIGS. 1 to 4. End sections of the contact levers 2 and 3 and in particular of the first contact lever arms 2.1 and 3.1 (not completely shown here) and of the second contact lever arms 2.2 and 3.2 extend out of the housing 12.

For a more detailed description of the bearing arrangement of the pivotable holding element 20 or 21, reference is made to FIGS. 6 to 8 below.

Figure 6:
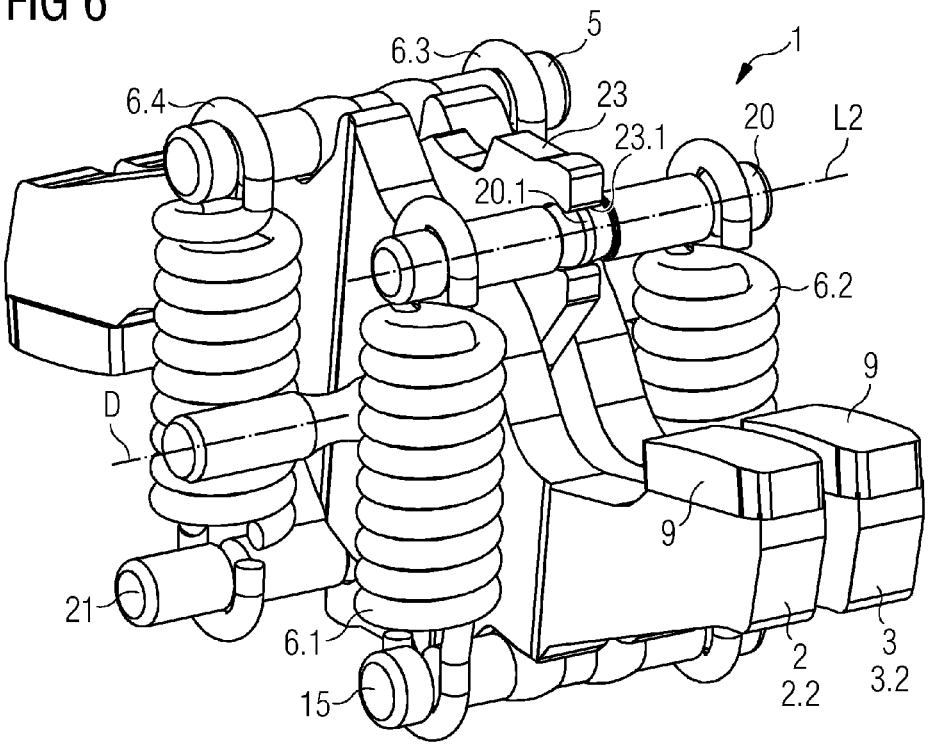
FIG. 6 shows a perspective view of the embodiment of the switch apparatus according to the invention shown in FIG. 5, without a housing.

FIG. 6 shows a perspective view of the embodiment of the switch apparatus 1 according to the invention shown in FIG. 5 without the housing 12. The arrangement and configuration of the first force transfer element 5 and second force transfer element 15 substantially corresponds to the arrangement of the force transfer elements 5 and 15 explained in the description provided in respect of FIGS. 1 to 4, and therefore reference is hereby made in full to this description or these explanations. The holding element 20 has a longitudinal axis L2, which extends substantially parallel to and in the same direction as a rotation axis D of the contact levers 2, 3. In the case of an asymmetrical system or an asymmetrically configured switch apparatus, however, it would also be conceivable for the longitudinal axis L2 of the holding element 20 to extend at a defined angle to the rotation axis D. Advantageously, the switch apparatus 1 has at least one holding element 20, which is arranged movably relative to power line elements (not shown here), wherein it is also possible for the switch apparatus 1 to have two holding elements 20 and 21, which are arranged movably relative to the power line elements.

The arrangement of a movable holding element 20 or 21 will be described below with reference to the first holding element 20, wherein this arrangement and configuration of the first holding element 20 can also be applied to the second holding element 21.

The holding element 20 is held and advantageously positioned by a holding arm 23. In this case, the holding arm can be fixed, for example, in a region of the housing 12 shown in FIG. 5 and can advantageously be arranged rigidly or in rotationally rigid fashion. In accordance with the embodiment of the switch apparatus 1 according to the invention shown in FIG. 6, the holding arm 23 extends along a region between the contact levers 2 and 3. The holding arm 23 has a cutout 23.1 in the form of a depression or groove, which engages around or surrounds the holding element 20 at least sectionally in the circumferential direction. Advantageously, the holding element 20 is held or mounted centrally by way of the holding arm 23. The holding element 20 also has an articulated section 20.1, which is arranged in the cutout 23.1. The articulated section 20.1 advantageously has a spherical configuration, which extends radially outwards, starting from the centrally arranged longitudinal axis L2 of the holding element 20, in the form of a bulge or protuberance, lying in a depression, uniformly in the circumferential direction of the holding element 20. An articulated bearing 24 and in particular a revolute joint bearing is realized by way of the cutout 23.1 and the shaped articulated section 20.1, which bearing is advantageously configured in the form of a ball joint.

Figure 8:
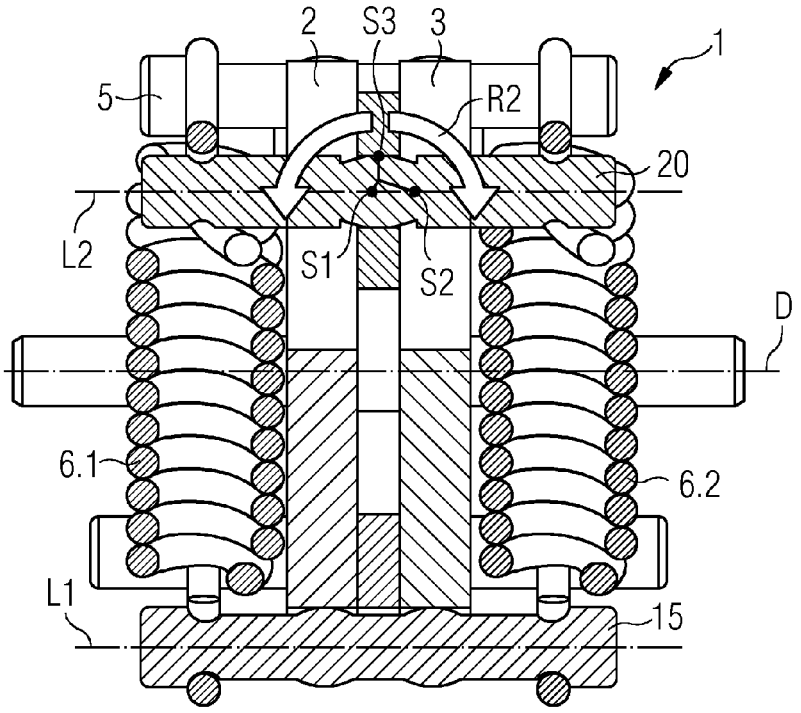
FIG. 8 shows a front view of the partial section shown in FIG. 7 of the embodiment of the switch apparatus according to the invention.

The configuration of the articulated section 20.1 is also additionally illustrated once again in FIGS. 7 and 8, wherein FIG. 7 shows a perspective view of a partial section through a force transfer pair 30 of in total two force transfer pairs 30 and 31 illustrated of the embodiment of a switch apparatus 1 according to the invention shown in FIGS. 5 and 6, and FIG. 8 shows a front view of the partial section of the embodiment of the switch apparatus 1 according to the invention shown in FIG. 7. Advantageously, a force transfer pair 30 or 31 has at least one force transfer element 5 or 15 and an associated holding element 20 or 21, wherein the holding elements 20 or 21 themselves can be configured in the same way as described in FIGS. 1 to 4 and would therefore not implement a movement with respect to the power line elements (not shown here). Each force transfer pair 30 or 31 also has at least one spring element 6 and in particular two spring elements 6.1 and 6.2 or 6.3 and 6.4, wherein each spring element 6, 6.1-6.4 extends between a force transfer element 5 or 15 and the associated holding element 20 or 21, with the result that the spring force applied by the spring element 6, 6.1-6.4 can be transferred to the force transfer element 5 or 15 and from there to the contact levers 2, 3 and in particular the corresponding contact lever arms 2.1 and 3.1 or 2.2 and 3.2. In the case of a force transfer pair 30 or 31, the force transfer element 5 or 15 is arranged on a first side O1 or surface O1, while the associated holding element 20 or 21 is arranged on a second side O2 or surface O2, which is opposite the first side O1 or surface O1 of the contact lever arm 2.1 or 3.1 or 2.2 or 3.2. The contact sections 9 for making contact with the mating contact sections 8 are advantageously arranged on the second side O2 or surface O2 of the contact lever arm 2.1, 2.2, 3.1, 3.2 of the contact lever 2, 3. Based on the diametric arrangement of the contact lever arms 2.1 and 2.2 or 3.1 and 3.2 of the individual contact levers 2 or 3, each contact lever 2 or 3 has a side along which a first surface O1 of, for example, a first contact lever arm 2.1 or 3.1 and a second surface O2 of, for example, a second contact lever arm 2.2 or 3.2 of the respective contact lever 2 or 3 extend.

Owing to the arrangement of the holding element 20 or 21 within the abovementioned cutout 23.1 in the holding element arm 23 and therefore owing to the formation of a revolute joint or an articulated bearing 24, the holding element 20 or 21 can be pivoted or rotated at least about a pivot axis S1, as illustrated in FIG. 8. The pivot axis S1 advantageously extends orthogonal to the rotation axis D, wherein it is also conceivable for the pivot axis S1 to extend relative to the rotation axis D at a defined angle, such as an acute angle or an obtuse angle, as illustrated schematically by the reference symbol S2. Advantageously, the pivot axis S1 or else the pivot axis S2 extends in a plane which extends parallel to a plane within which the rotation axis D extends. However, it is also conceivable for the pivot axis S1 and/or S2 to not extend parallel to the rotation axis D and, as a result, to lie in a plane or to extend in a plane which is oriented at a defined angle (acute angle or obtuse angle) to the plane in which the rotation axis D lies or in which the rotation axis D extends. This is illustrated schematically in particular by the reference symbol S3. Advantageously, the holding element 20 or 21 can be pivoted about the pivot axis S1 or S2 or S3 at least in the pivoting direction R2 in order to be able to compensate for asymmetries based on, for example, manufacturing tolerances of the component parts, as a result of which, in turn, identical contact-pressure forces are produced between the individual contact sections 9 and mating contact sections 8.

LIST OF REFERENCE SYMBOLS

1 switch apparatus
2 first contact lever
2.1 first contact lever arm of first contact lever
2.2 second contact lever arm of second contact lever
3 second contact lever
3.1 first contact lever arm of second contact lever
3.2 second contact lever arm of second contact lever
4 rotor
5 first force transfer element
5.1, 5.2 touching section of force transfer element
5.3, 5.4 bulge
6 spring element
6.1 first spring element
6.2 second spring element
6.3 third spring element
6.4 fourth spring element
7 power line element
7.1 power feedline element
7.2 outgoing power line element
8 mating contact section
9 contact section
10.1 first holding element
10.2 second holding element
11 holding arm

12 housing
15 second force transfer element
20 first holding element (pivotable)
20.1 articulated section
21 second holding element (pivotable)
23 holding arm
23.1 cutout
24 articulated bearing
30 first force transfer pair
31 second force transfer pair
D rotation axis
F1, F2 force acting on contact lever arm
$F_{F1}$ spring force of first spring element
$F_{F2}$ spring force of second spring element
$F_{F3}$ spring force of third spring element
$F_{F4}$ spring force of fourth spring element
$F_{K1}$ contact-pressure force on contact section of first contact lever arm of first contact lever
$F_{K3}$ contact-pressure force on contact section of second contact lever arm of first contact lever
$F_{K2}$ contact-pressure force on contact section of first contact lever arm of second contact lever
$F_{K4}$ contact-pressure force on contact section of second contact lever arm of second contact lever
H2, H3 heights
L1 longitudinal axis of first force transfer element
L2 longitudinal axis of first holding element
$l_{k1}$ length of first spring element
$l_{k2}$ length of second spring element
O1 first surface/side of contact lever arm
O2 second surface/side of contact lever arm
P1, P2 touching point
R1 first direction of rotation
R2 pivoting direction
$S_F$ current flow of electric current
S1 pivot axis
S2 pivot axis
S3 pivot axis
X asymmetry

What is claimed is:

1. A switch apparatus of an electrical circuit breaker for interrupting a current flow of an electric current in an electrical circuit in an event of an occurrence of a tripping event, the switch apparatus comprising:

two contact levers, arranged rotatably about a common rotation axis and arranged, at least sectionally, parallel to one another and spaced apart from one another, the two contact levers each including two contact lever arms comprising contact sections each for respectively making contact with one respective fixed mating contact section of a power line element, wherein the two first contact lever arms, which extend on a first side of the rotation axis, make contact with a first force transfer element, and the two second contact lever arms, which extend on a second side of the rotation axis, make contact with a second force transfer element for applying a spring force to the contact lever arms, and wherein at least one force transfer element of the two force transfer elements has, in touching sections for touching the contact lever arms, a bulge, which extends radially outwards, for the uniform transfer of the spring force onto the contact lever arms.

2. The switch apparatus of claim 1, wherein the force transfer element is arranged tiltably via its bulge relative to the power line elements.

3. The switch apparatus of claim 1, wherein the bulge includes a spherical configuration, an elliptical configuration, a pyramidal configuration, a conical configuration, a cubical configuration, a prismatic configuration or a cylindrical configuration.

4. The switch apparatus of claim 1, wherein the spring force is applied to the respective force transfer elements by at least two spring elements, wherein the spring elements each extend between the respective force transfer element and a holding element for holding the spring elements.

5. The switch apparatus of claim 4, wherein the holding element is arranged movably relative to the power line elements by way of an articulated bearing.

6. The switch apparatus of claim 1, wherein the touching sections of the force transfer elements each include at least one touching point for touching the contact lever arms, and wherein the touching points generate an identical lever arm independently of the positioning of at least one of the force transfer elements and the contact lever arms relative to the power line elements on each contact lever arm.

7. A switch apparatus of an electrical circuit breaker for interrupting a current flow of an electric current in an electrical circuit in an event of an occurrence of a tripping event, the switch apparatus comprising:

two contact levers, arranged rotatably about a common rotation axis arranged, at least sectionally, parallel to one another and spaced apart from one another, the two contact levers each including two contact lever arms comprising contact sections for respectively making contact with one respective fixed mating contact section of a power line element, wherein a first holding element for holding at least one spring element for applying a spring force to the first contact lever arms, which extend on a first side of the rotation axis, and a second holding element for holding at least one spring element for applying a spring force to the second contact lever arms, which extend on a second side of the rotation axis, are arranged, and wherein at least one holding element of the two holding elements is configured so as to be movable relative to the power line elements by way of an articulated bearing.

8. The switch apparatus of claim 7, wherein the articulated bearing comprises a revolute joint, to enable a pivoting movement of the holding element at least about a pivot axis, which extends substantially orthogonal or at a defined angle to the rotation axis.

9. The switch apparatus of claim 7, wherein a spring force is applied to the respective holding elements by at least two respective spring elements, and wherein the spring elements each extend between the respective holding element and a force transfer element for transferring a spring force onto the contact lever arms.

10. The switch apparatus of claim 7, wherein the switch apparatus includes at least one force transfer element.

11. The switch apparatus of claim 1, wherein the at least one force transfer element extends along a longitudinal axis, which extends substantially parallel to or at an acute angle or at an obtuse angle to a rotation axis of the contact lever arms, and wherein the force transfer element extends along a first surface of the contact lever arms, and the holding element extends along a second surface, opposite the first surface, of the contact lever arms.

12. An electrical circuit breaker for interrupting a current flow of an electric current in an electrical circuit, comprising:

at least one switch apparatus as claimed in claim 1.

13. The switch apparatus of claim 2, wherein the bulge includes a spherical configuration, an elliptical configuration, a pyramidal configuration, a conical configuration, a cubical configuration, a prismatic configuration or a cylindrical configuration.

14. The switch apparatus of claim 2, wherein the spring force is applied to the respective force transfer elements by at least two spring elements, wherein the spring elements each extend between the respective force transfer element and a holding element for holding the spring elements.

15. The switch apparatus of claim 14, wherein the holding element is arranged movably relative to the power line elements by way of an articulated bearing.

16. An electrical circuit breaker for interrupting a current flow of an electric current in an electrical circuit, comprising:

at least one switch apparatus as claimed in claim 7.

* * * * *